US005779202A

United States Patent [19]

Black et al.

[11] Patent Number: 5,779,202

[45] Date of Patent: Jul. 14, 1998

[54] PIVOTING MAILBOX POST

[76] Inventors: Roland L. Black; Sara J. Black, both of 7645 Scarff Rd. S., New Carlisle, Ohio 45344

[21] Appl. No.: 804,003

[22] Filed: Feb. 21, 1997

[51] Int. Cl.[6] ..... B65D 91/00

[52] U.S. Cl. ..... 248/122.1; 248/289.31; 248/145; 248/900; 232/39

[58] Field of Search ..... 248/548, 122.1, 248/125.7, 219.2, 289.31, 289.11, 900, 131; 232/39; 52/155

[56] References Cited

U.S. PATENT DOCUMENTS

| | | | |
|---|---|---|---|
| 759,437 | 5/1904 | Harward | 248/289.31 |
| 839,607 | 4/1906 | Lanie . | |
| 963,329 | 7/1910 | Shank | 248/289.31 X |
| 1,240,190 | 10/1917 | Forth . | |
| 1,273,696 | 7/1918 | Vanhoof | 248/289.31 X |
| 1,616,432 | 2/1927 | Aarseth . | |
| 1,645,768 | 10/1927 | Morten, Jr. | 248/289.31 X |
| 2,193,378 | 3/1940 | Pope | 232/39 |
| 2,194,900 | 3/1940 | Helten | 248/289.31 X |
| 2,669,408 | 8/1954 | Cox | 248/146 |
| 3,637,178 | 1/1972 | Golden | 248/289.31 X |
| 3,802,656 | 4/1974 | Virblas | 248/289.31 X |
| 3,870,262 | 3/1975 | Manning | 248/145 |
| 3,899,150 | 8/1975 | Racquet | 248/145 |
| 4,130,239 | 12/1978 | Belsheim | 232/39 |
| 4,172,579 | 10/1979 | Steinman | 248/145 |
| 4,484,705 | 11/1984 | Sande | 232/39 |
| 4,616,799 | 10/1986 | Robentisch | 248/289.3 |
| 4,667,918 | 5/1987 | Page | 248/418 |
| 4,893,747 | 1/1990 | Roth | 232/39 |
| 4,995,576 | 2/1991 | Kieswetter | 248/145 |
| 5,020,720 | 6/1991 | Harpe | 232/39 |
| 5,167,364 | 12/1992 | Wenning | 232/39 |
| 5,437,409 | 8/1995 | Coushaine | 232/39 |

*Primary Examiner*—Ramon O. Ramirez
*Assistant Examiner*—Long Dinh Phan

[57] ABSTRACT

A pivoting mailbx post is provided having a mailbox support arm that can be pivoted 360 degrees and easily returned to its normal resting position. It has an adjustment nut that allows increased tension on mailbox support arm for various weather conditions. At all times the support arm is maintained in a horizontal position and does not tilt. The homeowner can swing support arm completely around to empty contents without venturing into the street and traffic. This invention can be easily assembled and transported by the majority of homeowners. The pivoting mailbox will also have the ability to have damaged parts replaced.

6 Claims, 3 Drawing Sheets

PIVOTING MAILBOX POST

BACKGROUND-FIELD OF INVENTION

The invention relates to rural mailboxes, particularly support apparatus that makes the mailbox resistant to damage by being vandalized or struck by car, truck or snow plow.

BACKGROUND-DESCRIPTION OF PRIOR ART

Urban mailbox posts have long since been a source of constant maintenance and damage repair. If proper upkeep is not provided, the result is often rather unsightly and mail delivery often interrupted.

The greatest potential damage to a mailbox comes from snow plows moving down the road at a moderate to high rate of speed. Attempting to do the best job possible of clearing the road, the plow gets as close to the edge of the road as possible without hitting the mailboxes. Even if the snow plow blade misses the mailbox, the snow trailing off the plow blade has been known to completely destroy even the sturdiest mailbox post.

U.S. Post Office specifications require that the mailbox extend to the road, so that mail carrier can deliver the mail without leaving the vehicle. To remove the mail, the homeowner must stand in the street, putting the person close or in the actual path of approaching traffic. The first sight or sound of traffic approaching usually results in the mail recipient leaving the road. Roadside mailbox supports come in a wide variety of designs. These range from the basic 4×4 post support to elaborate decorative designs. The most basic design uses a 4×4 inch wooden post with its member's lap jointed together. This design is rigid and has been weakened by the lap joint construction. The half lap joints that hold locks the two pieces together actually remove about half the wood and, correspondingly, half the holding strength. The original 4×4 post is now actually 2×4 at this joint. The joint is where all the force is exerted when struck by a car or plow. Usually, the support fails at this location and is a complete loss.

Numerous attempts have been made to achieve crash protection for mailbox supports.

U.S. Pat. No. 3,870,262, issued to Manning, Jr. on Mar. 11, 1975, discloses a mailbox support that pivots when struck by a vehicle. However, the mailbox and its support bar slip from its bearing supports and falls to the ground along the road. Once on the ground, it is subject to additional damage, can be easily moved substantial distances or be lost in the snow.

U.S. Pat. No. 4,667,918, issued to Page on May 26, 1987, and U.S. Pat. No. 4,893,747, issued to Roth on Jan. 16, 1990, both disclose mailbox supports that allow the mailbox to rotate but first a pin or latch has to be activated. While these designs permit the homeowner to access the mail in the box without entering the road, they do not protect the mailbox from impacts from cars or snow plows.

U.S. Pat. No. 4,130,239, issued to Belsheim on Dec. 19, 1988, and U.S. Pat. No. 4,995,576, issued to Kieswetter on Feb. 26, 1991, both disclose similar pivoting actuation when stuck from the side. Both disclose the use of a pipe inside a pipe at an angle to give the mailbox assembly a pivot to spin around. The angle of the pivot pipe uses the uncertainty of gravity alone to attempt to return the mailbox to its original position. Also, wind could cause the mailbox to sway in an unsightly manner. The mail box also must leave its horizontal orientation and rise upwards at an angle as it rotates through a possible full circle. The speed of pivoting is a function of the force striking the mailbox. Gravity is the only restoring force that places the mailbox back into position once it's struck.

U.S. Pat. No. 3,889,150, issued to Racquet on Aug. 12, 1975, discloses the use of a long torsion spring inside a round pipe support that is said to yield to a sideward load and then return the mailbox to its original position. Frictional variations due to the introduction of water, salt or sand into the mechanism could affect the return position and result in the return position being different then the original position.

U.S. Pat. No 5,167,364, issued to Wenning on Dec. 1, 1992, discloses the use of an internally grooved cam slot to allow the mailbox to rotate about the mailbox post. This design requires a round pipe to fit snugly within a square metal tube. Also, bearings would be necessary to assure a smooth and consistent rotatable motion. Further, cutting the complex three-dimensional curved cam path around the internal pipe is difficult. This results in this apparatus being expensive to manufacture.

U.S. Pat. No. 4,172,579, issued to Steinman on Oct. 30, 1979, discloses a spring-detent design that retains the mailbox support in either the normal "facing the road" position or 90 degrees left or right of that position. Once the mailbox is dislodged, the homeowner must manually correct the position. This design also allows the assembly to be rotated 360 degrees and stop anywhere during its rotation. Friction between the surfaces in contact would have a great impact on performance, thus susceptible to being adversely effected by salt and sand. Also, the design permits the mailbox to swing upward.

U.S. Pat. No. 5,437,409, issued to Coushaine on Aug. 1, 1995, discloses a spring type design that works on angles that allow rotation up the angle and spring to push it down the angle to center. This design on hard impact can be broken or bent at upper and lower support arm. The box itself would be impacted on every strike causing the box damage. This apparatus would be expensive to manufacture.

A mailbox support that is vitually maintenance free, enables the homeowner to turn the mailbox in any direction to retrieve the mail, pivots when struck yet is inexpensive to manufacture, is not found in prior art.

OBJECTS AND ADVANTAGES

It is an object of the invention to provide a pivoting mailbox post that is durable with its performance relatively independent of water, salt and sand.

Another object of the invention is to provide a pivoting mailbox post that is economical to manufacture.

It is still another object of the invention to provide a pivoting mailbox post that can be produced in a number of attractive designs.

Another object of the invention is provide a pivoting mailbox post that allows the homeowner to empty the contents of the box without entering the street.

Another object of the invention is to provide a pivoting mailbox post that pivots when struck from the side and is easily returned to its original position.

It is an object of the invention to provide a pivoting mailbox post that does not require maintenance of the pivoting mechanism from the effects of salt, sand and water.

Another object of the invention is to provide a pivoting mailbox post that maintains the mailbox in a horizontal position, even when it pivots when struck.

It is another object of the invention to provide a pivoting mailbox post that is not easily dismantled or damaged by vandals.

Another object of the invention is that it is easily transported, assembled and installed by the homeowner.

It is the object of the invention to provide a pivoting mailbox post that will allow replacement of damaged parts.

It is a final object of the invention to provide a pivoting mailbox post that meets all United States Post Office regulations and guidelines.

The invention is a pivoting mailbox post that will allow 360 degree's rotation of the mailbox support arm. This includes a lower vertical post, mailbox support arm, upper vertical post and a decorative cap on top. The lower post has a centered vertical opening to accommodate a shaft that has two horizontal holes to allow a pin to pass through the post and shaft and be secured. The shaft will then extend vertically through a hole in the support arm and extends through a centered vertical hole in the upper post. The shaft will have two horizontal holes to allow a pin to pass through the upper post and shaft and be secured. The shaft will extend through the upper post and the end will be threaded to accommodate a nut and washer which can be tightened to increase tension on the mailbox support arm. A decorative cap will then be screwed on the extending threads to completely cover the nut and washer. The cap will prevent the incursion of salt, sand and water.

REFERENCE NUMERALS IN DRAWINGS

10 mailbox support arm

12 upper post

14 lower post

20 nut

22 flat washer

24 bolt

26 flat washer

28 nut

32 hole

34 oblong hole in shaft

36 shaft threaded on exposed end

42 beveled hole with threads

30 flat washer

48 wood section

50 mailbox

52 screws

38 vertical hole

DETAILED DESCRIPTION OF THE INVENTION

Figure 1:
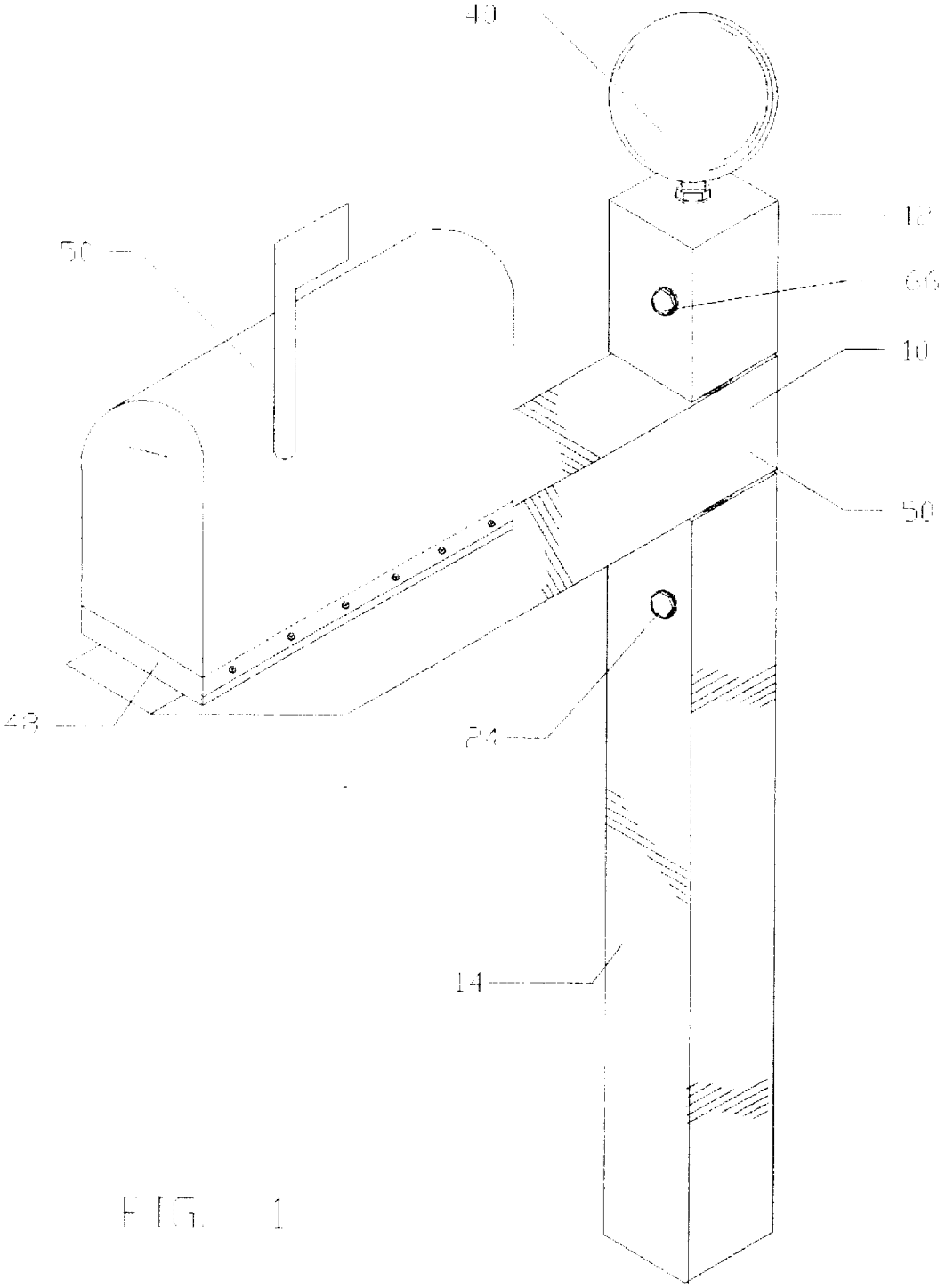
FIG. 1 is an isometric side elevation view of the pivoting mailbox post in its normal resting position.

FIG. 1 is an isometric side elevation view of the pivoting mailbox in its normal resting position. Mailbox support arm 10 rests between upper post 12 and lower post 14 and is held at a perfect horizontal position. The ninety degree angle formed by support arm 10 with upper post 12 forms a platform for any size mailbox. Support arm 10 also includes pivoting portion 30. On this platform would be a section of wood 48 the width of the mailbox. This section of wood 48 can be nailed or screwed to support arm 10. The flange on each side of the standard mailbox has six holes by which the mailbox can be either nailed or screwed to this section of wood 48. The leading edge of this section of wood 48 would be the first to be struck resulting in no damage to the mail box itself. The normal receptacle for a newspaper can be attached to support arm 10 on the side opposite traffic flow and out of harms way. Decorative cap 40 is shown in its position on top of upper post 12 and be will detailed in later drawing as to its function. This decorative cap 40 can be of any style or shape the homeowner would prefer. The heads of the bolt 24 are shown and will be detailed in later drawings.

Figure 2:
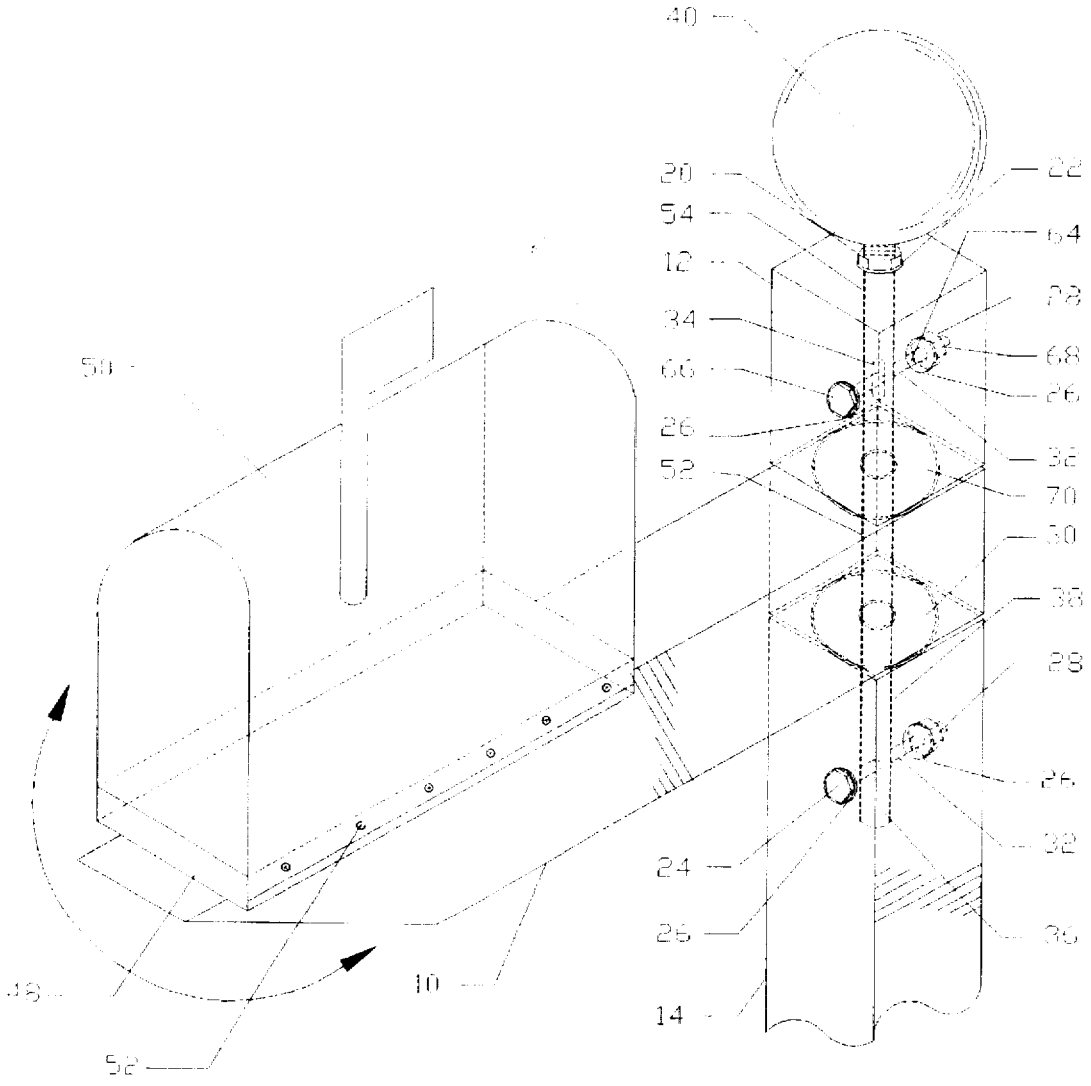
FIG. 2 is an isometric hidden view drawing of the post showing its internal components.

FIG. 2 is an isometric hidden view drawing of the post showing its internal components. Shaft 36 is inserted in a vertical bore 38 in lower post 14 and bolt 24 with flat washer 26 is inserted from the front through hole 32 in the lower post 14 and through the hole 32 in the shaft 36 and out of the back of lower post 14 through hole 32. Bolt 24 is then secured with flat washer 26 and nut 28 and tightened appropriately. Washer 30 is placed on shaft 36 and rests on lower post 14. Support arm 10 is then placed on shaft 36 through support arm vertical bore 52 and slid down shaft 36 until support arm 10 rests on washer 30 on first washer means 30. Second washer means 30 is placed on shaft 36 and rests on support arm 10. Upper post 12 is inserted on shaft 36 through upper post section vertical bore 54 until it rests on second washer means 70. Bolt 24 with flat washer 26 is inserted from the front through hole 32 in upper post 12 and through the elongate hole 34 in shaft 36 and out the back of upper post 12 through hole 32. Bolt 24 is then secured with a flat washer 26 and a nut 28 and tightened appropriately. Flat washer 22 is placed on the extended end of shaft 36 and then nut 20 is screwed on to threads of shaft 36 This will lock lower post 14, support arm 10 and upper post 12 together. Nut 20 is also the adjustment to increase pressure on upper post 12 which in turn compresses the support arm 10. This will allow adjustment of how easily the support arm 10 will pivot. Mailbox 50 is attached to section of wood 48 by mean of screws 52. Section of wood 48 is attached to support by screws (not shown).

Figure 3:
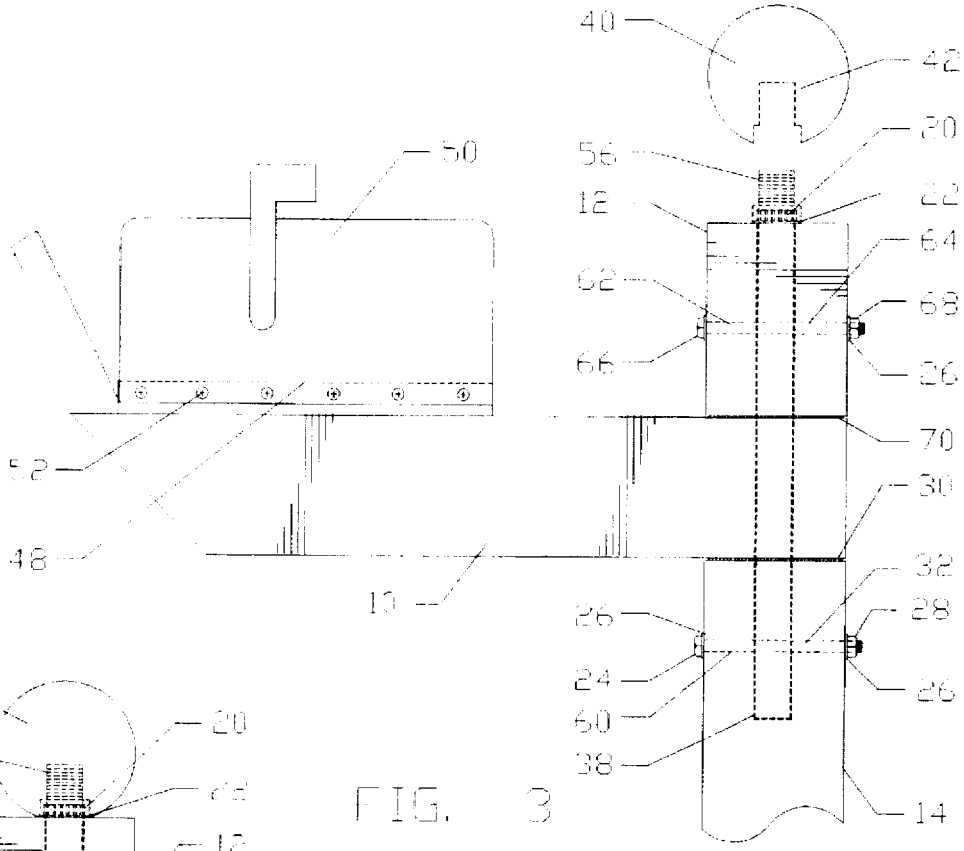
FIG. 3 is a view from the right side showing its internal components and cap cover.

FIG. 3 is a side view showing the first rotational prevention means 60 of the present invention. Rotational prevention means 60 comprises bolt 24 secured by fastener 28 and further includes flat washers 26. Support arm 10 is shown as it would pivot about the shaft 36 through the second rotational prevention means 62. Second rotational prevention means 62 comprises an upper post section aperture 64 aligned with the elongate shaft aperture 34 (seen in FIG. 4) and held with bolt 66 and nut 68. Upper post 12 is secured to shaft 36 by bolt 24 with flat washer 26 passing through hole 32 from front to back and secured with washer 26 and nut 26. The end of shaft 36 is threaded forming threaded shaft adjustment portion 56 to accept flat washer 22 and nut 20. Decorative cap 40 is shown in cross section to reveal beveled hole 42 with threads which screws on threaded end of shaft 36. This decorative cap 40 will completely cover flat washer 22 and nut 20 when tightened against the top of upper post 12. This decorative cap 40 will prevent the incursion of salt, sand and water.

Figure 4:
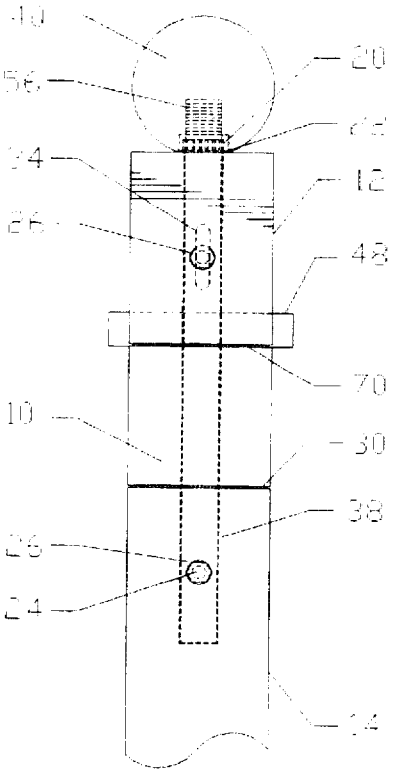
FIG. 4 is a view from the back showing its cap in position and function of oblong hole.

FIG. 4 is rear view showing bolt 24 with flat washer 26 passing through lower post 14 and shaft 36. It also shows bolt 24 with washer 26 passing through upper post 12 and elongated hole 34. The elongated hole 34 shows how upper post can be adjusted downward to tighten support arm 10 between upper post 12 and lower post 14 thus controlling the movement of support arm 10. Also shown is decorative cap 40 in its normal position covering the end of shaft 36, nut 20 and flat washer 22.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

We claim:

1. A pivoting mailbox post comprising:

a substantially vertically disposed lower post section including anchoring means for anchoring said lower post section into a ground and further including a centrally disposed vertical longitudinal bore extending partially into said lower post section;

a substantially horizontally disposed mailbox support arm having a mailbox support portion and a pivoting portion, said pivoting portion including a support arm vertical bore;

a substantially vertically disposed upper post section including a centrally disposed vertical longitudinal bore extending completely through said upper post section; and a shaft disposed within said lower post section vertical longitudinal bore, said mailbox support arm vertical bore, and said upper post section vertical longitudinal bore, where said mailbox support arm is disposed between and is in frictional contact with both said upper post section and said lower post section and where said mailbox support arm is rotatable about said shaft and where said shaft further extends through and above said upper post section to define a threaded adjustment portion on said shaft; whereby said lower post section is fixed into the ground, and where said lower post section vertical longitudinal bore, said mailbox support arm vertical bore, and said upper post section vertical longitudinal bore are aligned, said shaft is placed within said aligned bores such that said mailbox support arm is rotatable around said shaft, and where a nut adapted to fit on said threaded adjustment portion of said shaft may be tightened to set a desired amount of friction between said upper post section, said rotatable mailbox support arm, and said lower post section.

2. The pivoting mailbox post as claimed in claim 1, wherein said lower post section further includes first rotational prevention means attached to said shaft, said rotational prevention means comprising a first aperture through said lower post section and said shaft, said aperture adapted to receive a bolt and fastener to fix said shaft and said lower post section in relation to one another.

3. The pivoting mailbox post according to claim 2, wherein said upper post section further includes second rotational prevention means attached to said shaft, said second rotational prevention means comprising an aperture through said upper post section and an elongate aperture through said shaft, both said upper post section aperture and said elongate shaft aperture being disposed and aligned to accept a bolt and fastener to fix said shaft and said lower post section in relation to one another, and where said elongate aperture is further configured to allow said bolt and fastener to move within said elongate shaft aperture longitudinally when said nut on said threaded shaft adjustment means is manipulated.

4. The pivoting mailbox post according to claim 1, further including a first washer means disposed between said lower post section and said mailbox support arm and a second washer means disposed between said upper post section and said mailbox support arm, both said first and said second washer means surrounding said shaft.

5. The pivoting mailbox post according to claim 1, further including a removable cover means to substantially completely cover said nut and said threaded shaft adjustment means to prevent contamination by dirt or moisture.

6. A pivoting mailbox post comprising:

a substantially vertically disposed lower post section including anchoring means for anchoring said lower post section into a ground and further including a centrally disposed vertical longitudinal bore extending partially into said lower post section;

a substantially horizontally disposed mailbox support arm having a mailbox support portion and a pivoting portion, said pivoting portion including a support arm vertical bore;

a substantially vertically disposed upper post section including a centrally disposed vertical longitudinal bore extending completely through said upper post section;

a shaft disposed within said lower post section vertical longitudinal bore, said mailbox support arm vertical bore, and said upper post section vertical longitudinal bore, where said mailbox support arm is disposed between and is in frictional contact with both said upper post section and said lower post section and where said mailbox support arm is rotatable about said shaft and where said shaft further extends through and above said upper post section to define a threaded adjustment portion on said shaft;

said lower post section further includes first rotational prevention means attached to said shaft, said rotational prevention means comprising a first aperture through said lower post section and said shaft, said aperture adapted to receive a bolt and fastener to fix said shaft and said lower post section in relation to one another;

said upper post section further includes second rotational prevention means attached to said shaft, said second rotational prevention means comprising an aperture through said upper post section and an elongate aperture through said shaft, both said upper post section aperture and said elongate shaft aperture being disposed and aligned to accept a bolt and fastener to fix said shaft and said lower post section in relation to one another, and where said elongate aperture is further configured to allow said bolt and fastener to move within said elongate shaft aperture longitudinally when said nut on said threaded shaft adjustment means is manipulated; and said pivoting mailbox post further includes a first washer means disposed between said lower post section and said mailbox support arm and a second washer means disposed between said upper post section and said mailbox support arm, both said first and said second washer means surrounding said shaft; whereby said lower post section is fixed into the ground, and where said lower post section vertical longitudinal bore, said mailbox support arm vertical bore, and said upper post section vertical longitudinal bore are aligned, said shaft is placed within said aligned bores such that said mailbox support arm is rotatable around said shaft, and where a nut adapted to fit on said threaded adjustment portion of said shaft may be tightened to set a desired amount of friction between said upper post section, said rotatable mailbox support arm, and said lower post section.

* * * * *